US005115759A

United States Patent [19]

Kagayama

[11] Patent Number: 5,115,759

[45] Date of Patent: May 26, 1992

[54] DEVELOPER COATING APPARATUS

[75] Inventor: Shigeru Kagayama, Nagoya, Japan

[73] Assignee: Brother Kogyo Kabushiki Kaisha, Nagoya, Japan

[21] Appl. No.: 547,128

[22] Filed: Jul. 3, 1990

[30] Foreign Application Priority Data

Aug. 10, 1989 [JP] Japan ..... 1-207670

[51] Int. Cl.[5] ..... G03G 15/06

[52] U.S. Cl. ..... 118/621; 118/651; 118/653; 118/638

[58] Field of Search ..... 118/50.1, 621, 624-5, 118/638, 644, 647-649, 651-653, 661, 665-667, 669, 677-679; 355/73, 245, 259, 265, 312

[56] References Cited

U.S. PATENT DOCUMENTS

| | | | |
|---|---|---|---|
| 2,784,694 | 3/1957 | Cramrine et al. | 118/648 |
| 3,696,783 | 10/1972 | Fantuzzo | 118/652 |
| 4,492,178 | 1/1985 | Voirin et al. | 118/653 |
| 4,538,900 | 9/1985 | Lutus et al. | 118/652 |
| 4,646,677 | 3/1987 | Lounsbury, Jr. et al. | 118/658 |
| 4,769,676 | 10/1988 | Mukai et al. | 118/652 |
| 4,803,518 | 2/1989 | Haneda et al. | 355/265 |
| 4,865,943 | 9/1989 | Wright | 430/138 |

FOREIGN PATENT DOCUMENTS 2201803 9/1988 United Kingdom .

*Primary Examiner*—Michael G. Wityshyn
*Assistant Examiner*—Charles K. Friedman

[57] ABSTRACT

An apparatus is provided for coating a developer on the surface of a substrate of an image printing medium, the apparatus including a developer carrier holding thereon a layer of the developer in a charged state generated by frictional contact therewith, an electrode roller adapted to transport the substrate to and from a transfer region, and an alternating electric field produced between the developer carrier and the electrode roller, urging the developer on the carrier to take flight toward the substrate to form a coated layer of the developer on the surface thereof. With this developer coating apparatus, the developer which is imparted with vibration in the alternating electric field is efficiently coated on the substrate surface.

14 Claims, 3 Drawing Sheets

DEVELOPER COATING APPARATUS

BACKGROUND OF THE INVENTION

1. Field of the Invention

This invention relates to an apparatus for coating a developer on the surface of an ordinary paper sheet or a support body of other material to produce an image forming or printing medium with a coated layer of the developer.

2. Description of the Related Art

There has thus far been known in the art an image printing apparatus using a microcapsule-coated sheet bearing microcapsules which contain a dye precursor in a sealed state and having a photo-sensitive mechanical strength, in combination with an image printing medium which is prepared by coating a layer of a developer on an ordinary paper sheet or other support material selected by the user. The image printing medium is placed on an exposed microcapsule sheet in intimate contact therewith, and then the overlapped sheets are subjected to a stage of pressing development in which microcapsules of low mechanical strength in unexposed portions of the microcapsule sheet are crushed, causing the dye precursor to exude from the microcapsules and react with the developer to produce a picture image on the support body. In order to prepare the image printing medium, there has also been known an apparatus in which a developer carrier in the form of a roller or the like carrying thereon charged particles of a developer is positioned in non-contacting face-to-face relation with the support body, and the developer particles are put into flight toward the support body by the electrostatic force produced by an electric field.

As a developer carrier for use on an apparatus of this sort, it has been the general practice to employ a roller which is constituted by a cylindrical core member of metal and a sleeve-like cover member of an insulating material such as epoxy resin or the like for wrapping the circumferential surface of the core member and provided with knurling of grooves on the outer surface thereof, or by a cylindrical core member with an electrostatically piled surface. In this instance, the particulate developer is charged by friction against the roller and retained on the roller surface by the electrostatic force. The developer layer on the carrier is regulated to a predetermined thickness by a resilient blade which is pressed against the developer carrier. An electric field is produced between the developer carrier and the support body by an electrode roller which is adapted to apply direct current of high voltage to the support body.

With the related art developer coating apparatus as described above, however, if the electric field is intensified (e.g., to 5 kv/mm in a case where the gap between the developer carrier and the support body is 600 μm) for the purpose of coating the developer on the support body in an amount which is necessary to secure sufficient color development, there arises a problem that discharge marks remain on the development layer on the support body as a result of the high voltage discharge despite an increase in developer coating rate. If the field strength is lowered to a level free from such discharge marks (e.g., to about 2 kv/mm in this particular case), there will occur a material drop in developer coating rate, necessitating a slow down in the support body feed speed to a level far lower than the circumferential speed of the developer carrier and as a result requiring a considerably prolonged time for the developer coating operation.

In addition, there has been a problem that existence of charged developer of opposite polarity in the grooves knurled on the circumferential surface of the developer carrier invites drops in the developer portage by the developer carrier and accordingly in the developer coating efficiency.

SUMMARY OF THE INVENTION

The present invention contemplates solving the above-described problems and has as its object the provision of a developer coating apparatus which is capable of coating a large amount of developer in an efficient manner.

In accordance with one aspect of the present invention, the above-stated objective is achieved by the provision of a developer coating apparatus wherein an image printing medium is produced by coating a developer on the surface of a support body through a developer carrier in an electric field produced between the developer carrier and the support body, the coating apparatus comprising means for producing an alternating electric field between the developer carrier and the support body.

With the above-described arrangement according to the invention, the charged developer particles on the developer carrier are imparted with vibration by the alternating electric field between the developer carrier and the support body and are efficiently coated on the latter. Concurrently, the charged developer particles of the opposite polarity, which exist in grooves on the circumferential surface of the developer carrier are urged to take flight out of the grooves thereby further improving the coating efficiency without leaving discharge marks on the coated developer layer even at high voltages.

Therefore, according to the present invention, it becomes possible to increase the amount of the developer carried by the developer carrier and to feed the support body at high speed thereby to enhance the coating efficiency and, furthermore, permitting formation of a coated developer layer of a sufficient thickness free of discharge marks even when a high voltage is applied.

The above and other objects, features and advantages of the invention will become apparent from the following description and the appended claims, taken in conjunction with the accompanying drawings which show by way of example a preferred embodiment of the invention. It is to be understood that the drawings are given for the purpose of illustration only and therefore should not be construed as limitative of the invention.

DESCRIPTION OF PREFERRED EMBODIMENTS

Figure 1:
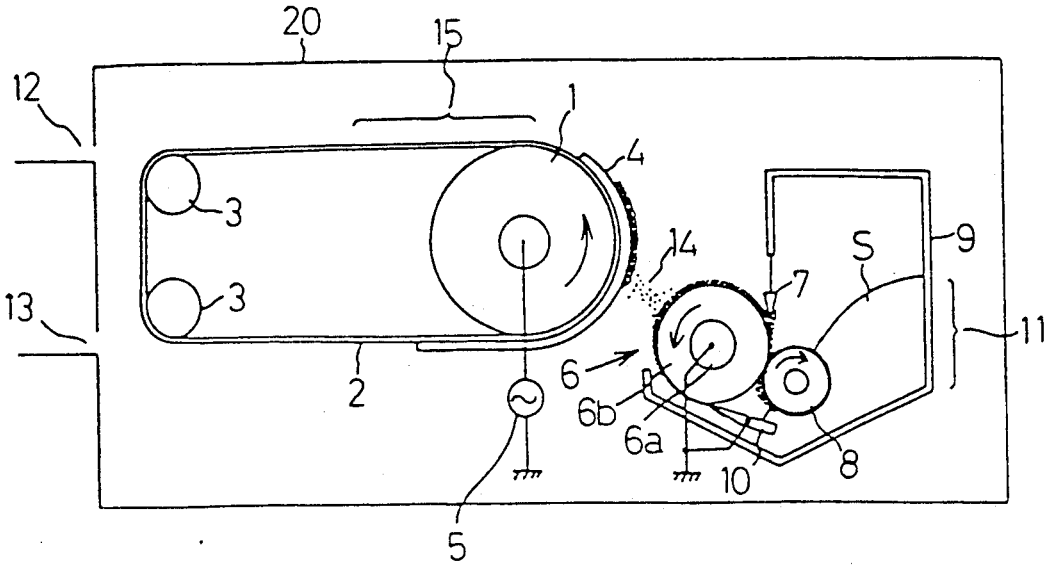
FIG. 1 is a schematic sectioned front view of a developer coating apparatus embodying the invention.

Hereinafter, the invention is described in greater detail by way of the embodiment of the invention shown in the drawings.

Referring to FIG. 1, there is shown a developer coating apparatus embodying the invention, including a housing 20 which is provided with an outlet 12 and an inlet 13. Accommodated in the housing 20 are a substrate sheet transfer unit 15 for transferring an ordinary paper sheet or other substrate sheet 4 to be coated with a developer S, and a developer feeder unit 11. The substrate transfer unit 15 includes an electrode roller 1 for applying a predetermined high ac voltage to the substrate 4, an ac voltage source 5, transfer rollers 3 for transporting the substrate 4, and a conveyer belt 2. On the other hand, the developer feeder unit 11 includes a developer carrier 6, a developer feed roller 8 provided as an auxiliary means for transferring the developer S onto the developer carrier 6, a regulator blade 7 for controlling the layer of the developer S on the carrier roller 6 to a predetermined thickness, and a cleaning brush 10 for removing the developer S on the carrier roller 6 immediately before a point where the carrier roller 6 comes into contact with the developer feed roller 8. The developer S of particulate form is stored in a case 9.

The substrate 4 retained on the transfer belt 2 is advanced to a transfer region 14 where the substrate 4 and the developer carrier 6 are disposed face to face across a predetermined gap.

Figure 4:
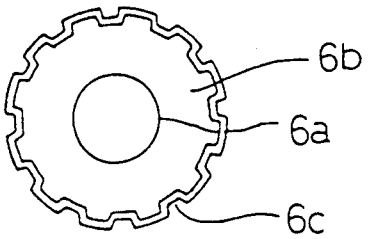
FIG. 4 is a close-up cross-sectional view of a first type of developer carrier used in the apparatus of FIG. 1.
Figure 5:
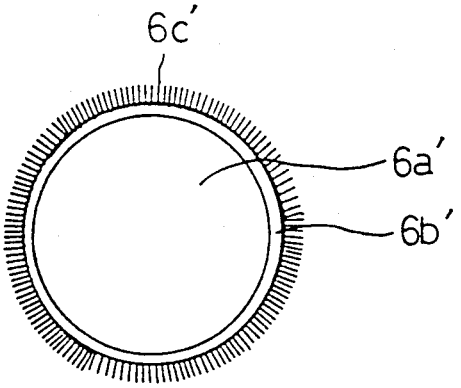
FIG. 5 is a close-up cross-sectional view of an alternative type of developer carrier.

Referring specifically to FIG. 4, the developer carrier 6 is constituted by a cylindrical core member 6*a* of a metal like aluminum and a sleeve-like cover member 6*b* fitted on the core member 6*a* in such a manner as to cover the circumferential surface of the latter. The cover member 6*b* may be provided with a knurled surface having grooves 6*c*. Alternatively, a developer carrier with an electrostatic piled surface 6*c*' as shown in FIG. 5 may be used. In this embodiment, 6*a*' depicts the cylindrical core member and 6*b*' depicts a cover member having the electrostatic piled surface 6*c*'. The developer is charged by friction against the surface of the cover member 6*b* (or 6*b*'). Accordingly, a sufficient amount of the developer is sustained on the developer carrier 6 by the electrostatic force.

In operation, upon actuating a motor which is not shown, the developer carrier 6 and the developer feed roller 8 are rotated in the arrowed directions, and the particulate developer S which is stored in the case 9 is transferred toward the developer carrier 6 by the feed roller 8. The developer S is triboelectrically charged by frictional contact with the surface of the cover member 6*b* (or 6*b*'), and a sufficient amount of the developer S is held on the developer carrier 6 by the electrostatic force. Further, the layer of the developer S retained on the surface of the carrier 6 is regulated into a predetermined thickness by the regulator blade 7 which is located on the downstream side of the carrier 6.

The developer S which has been seized in the charged state on the surface of the developer carrier 6 is advanced toward the transfer region 14.

On the other hand, the ordinary paper sheet or other substrate 4 to be coated with the developer S is introduced into the coating apparatus 20 through the inlet 13, and conveyed toward the transfer region 14 by the conveyer belt 2 which is turned by rotation of the electrode roller 1 and the transfer rollers 3. In this instance, the electrode roller 1 is of a metal and applied with a high ac voltage in the range of 1 KV to 10 KV from the ac voltage source 5, forming an alternating electric field in the transfer region 14. The ideal voltage will depend upon such factors as the circumferential speed of the carrier 6, the gap between the carrier 6 and the substrate 4, desired coating thickness of the developer and the frequency of the alternating current. With the apparatus in the EXAMPLE to be described, it was found that the most useful range is between 4 KV and 8 KV.

In the transfer region 14, the charged developer S forming a layer on the surface of the carrier 6 is urged to take flight toward the electrode roller 1 under the influence of the alternating electric field existing in that region, and as a result is coated on the substrate 4. At this time, the developer S is put in vibration in the alternating electric field to form a uniform coating on the substrate 4. The charged developer of the opposite polarity, which exists in grooves 6*c* provided on the knurled surface of the developer carrier 6, is also put into flight by the alternating electric field. This is reflected by an increase in the amount of developer deposition on the developer carrier 6 and therefore by a higher efficiency of developer coating on the substrate 4.

Although the grooved or piled surface of the developer carrier 6 bears a small amount of developer which was not put into flight by the electric field, the lingering developer is removed and neutralized as the tip end of a grounded cleaning brush 10 comes into contact with the surface of the developer carrier 6.

On the other hand, the substrate 4 coated with the developer S is transferred forward by operation of the conveyer 15 and discharged out of the coating apparatus 20 through the outlet 12.

The invention is illustrated more particularly by the following experimental example with regard to the developer coating rate in the invention.

EXAMPLE

Figure 2:
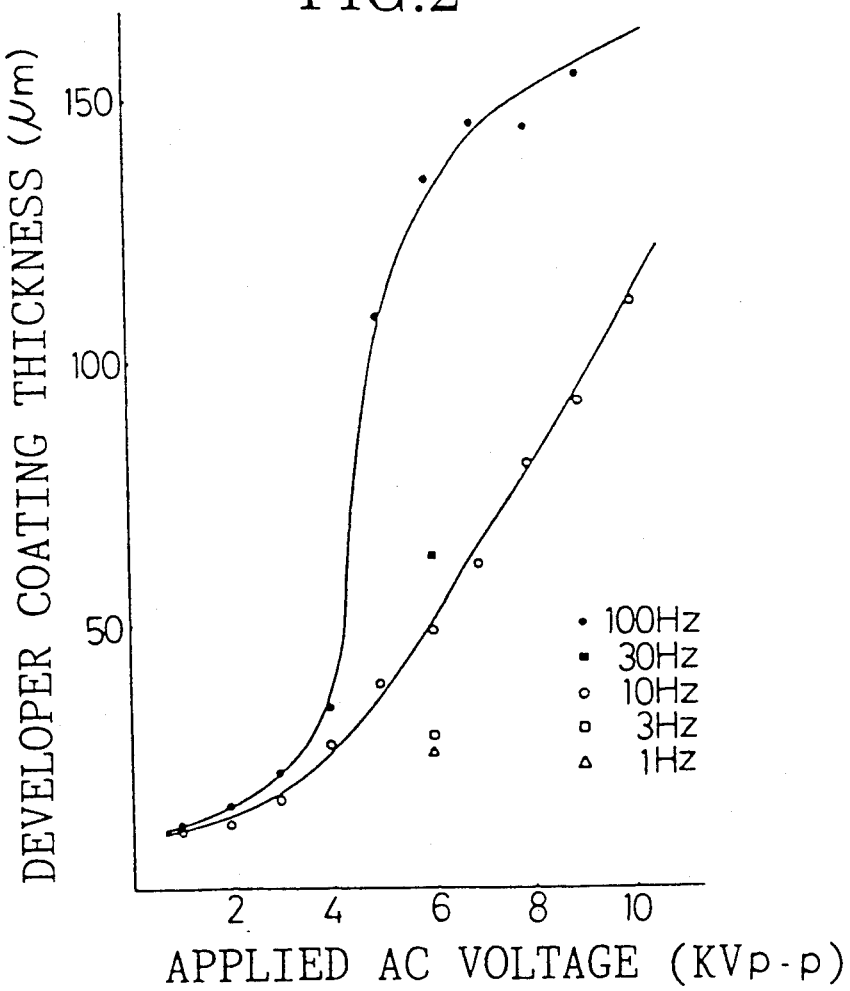
FIG. 2 is a diagram showing the voltage of applied alternate current in relation with the thickness of the coated developer in the embodiment of the invention.
Figure 3:
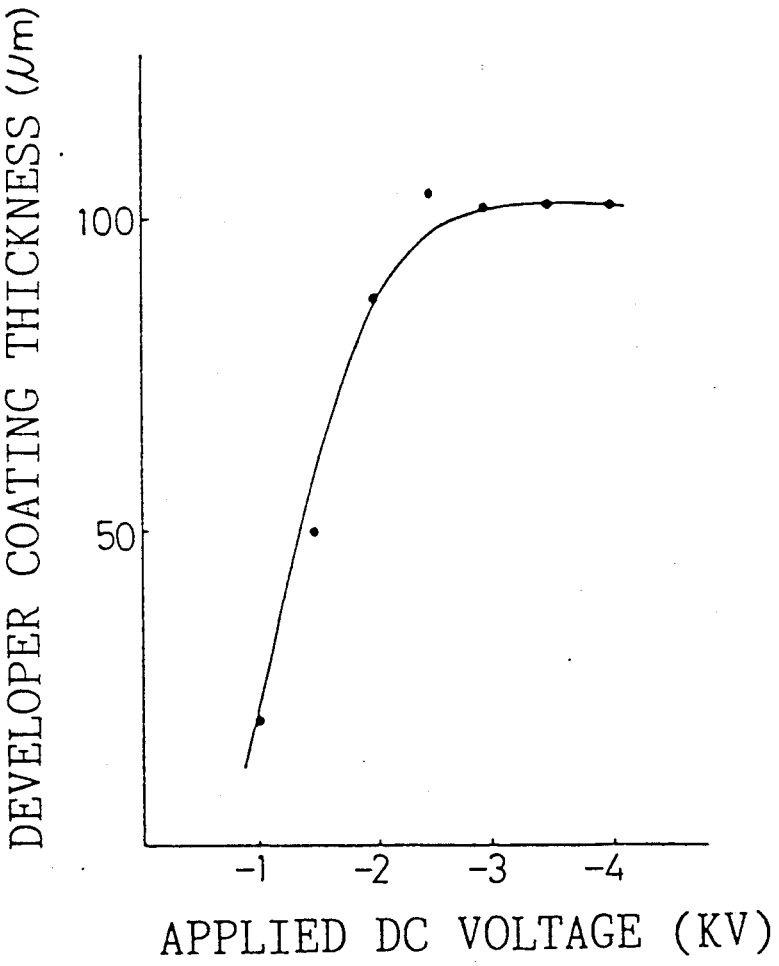
FIG.3 RELATED ART
FIG. 3 is a diagram showing the voltage of applied direct current in relation with the thickness of the coated developer in a conventional developer coating apparatus.

There was prepared a pilot apparatus with a construction as in FIG. 1, along with a developer carrier roller 6 having a core member 6*a* wrapped in a cover member 6*b* with electrostatically The developer coating thickness (μm) was measured with respect to varied ac voltage source frequencies of 10 Hz and 100 Hz and also with respect to varied frequencies with an ac source voltage of 6 kv, as shown in FIG. 2. For the purpose of comparisons the developer coating thickness (μm) was also measured by using a dc voltage source instead of the ac voltage source 5, with results as shown in FIG. 3. The conditions of measurement were as follows:

Circumferential speed of the carrier: 3000 mm/min
Substrate (ordinary paper) feed rate: 80 mm/min
Gap width between the carrier roller and the substrate: 600 μm As seen in FIG. 2, the higher the voltage applied by the source 5, the greater becomes the developer coating thickness, and, at a given voltage, the developer coating rate becomes greater as the frequency of the alternating field is increased. Under conditions of 8 kv and 100 Hz, there was obtained a developer coating of about 145 μm in thickness without discharge marks thereon.

In contrast, in the conventional developer coating in a dc electric field, there was obtained an about 100 μm thick developer coating at 2.5 kv, as indicated in FIG. 3, which however included stripe discharge marks. Additionally, round hole-like discharge marks appeared at 3 kv. Thus, according to the invention, the developer could be coated more efficiently without slowing down the substrate feed rate.

While the invention has been particularly shown and described with reference to preferred embodiments thereof, it is to be understood that various alterations and modifications in form and details can be made thereto by those skilled in the art without departing from the spirit and scope of the invention as encompassed by the appended claims.

What is claimed is:

1. A developer material coating apparatus for electrostatically coating developer material on a support member in a developer material coating region to form a developer sheet, comprising:

a support member feeding means for feeding the support member to the developer material coating region while carrying the support member thereon:

a developer material coating means for triboelectrically charging the developer material and electrostatically supplying the charged developer material to the support member disposed in the developer material to the support member disposed in the developer material coating region; and a producing means for producing an alternating electric field in the developer material coating region, sad producing means including an alternating current voltage source;

wherein the support member feeding means includes an electrode member attached to the alternating current voltage source so that a high alternating current voltage is supplied thereto by the alternating current voltage source so that the charged developer material is coated on the support member carried by the feeding means through the alternating electric field.

2. A developer material coating apparatus according to claim 1, wherein the alternating current voltage applied to the electrode roller is in the range of 1 kilovolt to 10 kilovolts.

3. A developer material coating apparatus according to claim 2, wherein said alternating current voltage is in the range of 4 kilovolts to 8 kilovolts.

4. A developer material coating apparatus according to claim 1, wherein the developer material coating region has a predetermined gap defined between the feeding means and the coating means and wherein the charged developer material is flown to the support member by the alternating electric field.

5. A developer material coating apparatus according to claim 1, wherein the feeding means comprises a pair of guide rollers and an endless belt for carrying the support member thereon, the endless belt being suspended among the electrode roller and the guide rollers.

6. A developer material coating apparatus according to claim 1, wherein the coating means comprises a case for accommodating the developer material, a carrier roller for carrying the developer material thereon, a feed roller for triboelectrically charging developer material and feeding the charged developer material to the carrier roller, and a blade for smoothing the developer material carried on the carrier roller.

7. A developer material coating apparatus according to claim 6, wherein the carrier roller has an uneven peripheral surface thereof for carrying the developer material thereon and feeding the developer material to the developer material coating region, and wherein the feed roller triboelectrically charges the developer material in cooperation with the carrier roller.

8. A developer material coating apparatus according to claim 7, wherein the uneven surface includes a number of grooves formed on the peripheral surface of the carrier roller by knurling, the developer material filling and being retained by the grooves and being fed to the developer material coating region.

9. A developer material coating apparatus according to claim 7, wherein the carrier roller comprises a metal shaft and an insulating sleeve member surrounding the shaft, the uneven surface being provided on the surface of the insulating sleeve member.

10. A developer material coating apparatus according to claim 7, wherein the uneven surface has piles formed by electrostatical implanting.

11. A developer material coating apparatus according to claim 6, further comprising a cleaning means for removing the charged developer material left on the peripheral surface of the carrier roller after feeding of the charged, developer material to the support member.

12. A developer material coating apparatus according to claim 11, wherein the cleaning means is a cleaning brush.

13. A developer material coating apparatus according to claim 11, wherein the cleaning means is grounded.

14. A developer material coating apparatus for electrostatically coating developer material onto a surface of a sheet, comprising:

means for receiving the sheet from an inlet, feeding the sheet past a developer material coating region for application of the developer material onto the surface of the sheet, and discharging the sheet after coating to an outlet, said means for receiving including an endless movable support which moves past said inlet, said developer material coating region, and said outlet;

a developer material coating means for triboelectrically charging the developer material and electrostatically supplying the charged developer material to the sheet on sad support disposed int he developer material coating region; and an alternating current voltage source attached to said support for producing an alternating electric field int he developer material coating region so that he charged developer material is coated on the sheet on said support through the alternating electric field when the support locates the sheet at said developer material coating region.

* * * * *